US010239100B2

(12) United States Patent
Banholzer et al.

(10) Patent No.: US 10,239,100 B2
(45) Date of Patent: Mar. 26, 2019

(54) DRAIN CLEANER

(71) Applicant: MILWAUKEE ELECTRIC TOOL CORPORATION, Brookfield, WI (US)

(72) Inventors: Hans T. Banholzer, Milwaukee, WI (US); Nikos A. Gainacopulos, Milwaukee, WI (US); Jacqueline J. Beierle, Milwaukee, WI (US); Sean T. Kehoe, Pewaukee, WI (US); Ryan James Denissen, Sussex, WI (US); Justin Miller, Milwaukee, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 0 days.

(21) Appl. No.: 15/953,643

(22) Filed: Apr. 16, 2018

(65) Prior Publication Data

US 2018/0229279 A1 Aug. 16, 2018

Related U.S. Application Data

(63) Continuation of application No. 15/862,360, filed on Jan. 4, 2018, now Pat. No. 9,975,154, which is a continuation of application No. 15/426,762, filed on Feb. 7, 2017, now Pat. No. 9,884,353, which is a (Continued)

(51) Int. Cl.

| | |
|---|---|
| ***B08B 9/047*** | (2006.01) |
| ***B08B 9/045*** | (2006.01) |
| ***B65H 75/36*** | (2006.01) |
| ***E03F 9/00*** | (2006.01) |

(52) U.S. Cl.

CPC ..... *B08B 9/047* (2013.01); *B08B 9/045* (2013.01); *B65H 75/364* (2013.01); *E03F 9/005* (2013.01); *B65H 2701/33* (2013.01)

(58) Field of Classification Search

CPC ..... B08B 9/047; B08B 9/045; E03F 9/005

See application file for complete search history.

(56) References Cited

U.S. PATENT DOCUMENTS

| | | | |
|---|---|---|---|
| 2,223,005 | A | 11/1940 | Kerber |
| 2,244,735 | A | 6/1941 | Silverman |
| 2,297,755 | A | 10/1942 | Faust |

(Continued)

FOREIGN PATENT DOCUMENTS

| | | |
|---|---|---|
| WO | 2006112847 | 10/2006 |
| WO | 2006112848 | 10/2006 |
| WO | 2009143497 | 11/2009 |

OTHER PUBLICATIONS

International Search Report and Written Opinion for Application No. PCT/US2016/065942 dated Feb. 10, 2017 (15 pages).

(Continued)

*Primary Examiner* — Shay Karls

(74) *Attorney, Agent, or Firm* — Michael Best & Friedrich LLP

(57) ABSTRACT

A drain cleaner includes a shroud with a closed end and an open end opposite the closed end, a drum assembly positioned within the shroud and rotatable relative to the shroud, a flexible cable stored within the drum assembly, and a handle assembly coupled to and extending rearwardly from the shroud. The handle assembly includes a motor, a grip, and an actuator to selectively energize the motor. The actuator is enclosed between the grip and the shroud.

17 Claims, 13 Drawing Sheets

Related U.S. Application Data continuation of application No. PCT/US2016/065942, filed on Dec. 9, 2016.

(60) Provisional application No. 62/296,453, filed on Feb. 17, 2016, provisional application No. 62/264,916, filed on Dec. 9, 2015.

(56) References Cited

U.S. PATENT DOCUMENTS

| | | | |
|---|---|---|---|
| 2,685,097 | A | 8/1954 | Allen |
| 2,849,870 | A | 9/1958 | Silverman |
| 3,078,486 | A | 2/1963 | Casto et al. |
| 3,093,854 | A | 6/1963 | Silverman |
| 3,246,354 | A | 4/1966 | Cooney et al. |
| 3,268,937 | A | 8/1966 | Bollinger |
| 3,414,926 | A | 12/1968 | Bloom |
| 3,460,501 | A | 8/1969 | Silverman |
| 3,480,983 | A | 12/1969 | Caperton |
| 3,574,878 | A | 4/1971 | Shames et al. |
| 3,662,421 | A | 5/1972 | Caperton |
| 3,691,583 | A | 9/1972 | Silverman et al. |
| 4,104,757 | A | 8/1978 | Silverman |
| 4,218,802 | A | 8/1980 | Babb et al. |
| 4,364,139 | A | 12/1982 | Babb et al. |
| D271,436 | S | 11/1983 | Babb et al. |
| 4,617,693 | A | 10/1986 | Meyer et al. |
| D287,178 | S | 12/1986 | Babb et al. |
| 4,734,951 | A | 4/1988 | Prange |
| 4,763,374 | A | 8/1988 | Kaye |
| 4,793,017 | A | 12/1988 | Kaye |
| D307,202 | S | 4/1990 | Moss |
| 4,914,775 | A | 4/1990 | Kirk |
| 4,925,214 | A | 5/1990 | Hazelton et al. |
| D310,280 | S | 8/1990 | Moss |
| 4,956,889 | A | 9/1990 | Kirk |
| 5,009,242 | A | 4/1991 | Prange |
| 5,031,263 | A | 7/1991 | Babb et al. |
| 5,031,276 | A | 7/1991 | Babb et al. |
| 5,130,707 | A | 7/1992 | Hagen |
| 5,365,874 | A | 11/1994 | Dorfman |
| 5,390,389 | A | 2/1995 | Rutkowski et al. |
| 5,419,349 | A | 5/1995 | Swain |
| 5,622,319 | A | 4/1997 | Babb et al. |
| 5,657,505 | A | 8/1997 | Gallagher et al. |
| 5,661,265 | A | 8/1997 | Yarbrough et al. |
| 5,816,165 | A | 10/1998 | Huston |
| 5,901,401 | A | 5/1999 | Rutkowski et al. |
| 5,924,566 | A | 7/1999 | Gibbs |
| 6,009,588 | A | 1/2000 | Rutkowski |
| 6,158,076 | A | 12/2000 | Rutkowski et al. |
| 6,243,905 | B1 | 6/2001 | Rutkowski |
| 6,343,398 | B1 | 2/2002 | Silverman et al. |
| 6,360,397 | B1 | 3/2002 | Babb |
| 6,381,798 | B1 | 5/2002 | Rutkowski et al. |
| 6,412,136 | B1 | 7/2002 | Rutkowsk |
| 6,470,525 | B1 | 10/2002 | Silverman |
| 6,546,582 | B2 | 4/2003 | Silverman |
| 6,615,436 | B1 | 9/2003 | Burch, Jr. et al. |
| 6,618,891 | B2 | 9/2003 | Schmitt |
| 6,618,892 | B2 | 9/2003 | Schmitt |
| 6,637,064 | B2 | 10/2003 | Silverman et al. |
| 6,760,948 | B2 | 7/2004 | Schmitt |
| 6,898,881 | B2 | 5/2005 | Morrison |
| D509,929 | S | 9/2005 | Rutkowski et al. |
| 7,070,044 | B2 | 7/2006 | Rosenfeld |
| 7,073,224 | B2 | 7/2006 | Schmitt |
| 7,137,503 | B2 | 11/2006 | Chesack et al. |
| 7,269,874 | B2 * | 9/2007 | Hung ..... B08B 9/045 15/104.095 |
| 7,367,077 | B2 | 5/2008 | Rutkowski et al. |
| D570,558 | S | 6/2008 | Rutkowski et al. |
| D579,612 | S | 10/2008 | Rutkowski et al. |
| D582,108 | S | 12/2008 | Duff et al. |
| 7,478,451 | B2 | 1/2009 | Rutkowski et al. |
| D595,911 | S | 7/2009 | Rutkowski et al. |
| 7,676,879 | B1 | 3/2010 | Rutenberg et al. |
| 7,685,669 | B2 | 3/2010 | Rutkowski et al. |
| 7,729,792 | B2 | 6/2010 | Lucas et al. |
| 7,793,608 | B1 | 9/2010 | Udouj |
| 7,806,256 | B2 | 10/2010 | Wildauer et al. |
| 7,935,192 | B2 | 5/2011 | Silverman et al. |
| 8,046,862 | B2 | 11/2011 | Eisermann et al. |
| 8,060,968 | B2 | 11/2011 | Babb et al. |
| 8,176,593 | B2 | 5/2012 | Gress et al. |
| 8,302,491 | B2 | 11/2012 | Stack |
| 8,413,347 | B2 | 4/2013 | Gress et al. |
| 8,434,186 | B2 | 5/2013 | Wildauer et al. |
| 8,539,618 | B2 | 9/2013 | Gibson et al. |
| 8,578,949 | B2 | 11/2013 | Kalbfeld et al. |
| 8,662,092 | B2 | 3/2014 | Kalbfeld et al. |
| 8,826,483 | B2 | 9/2014 | Rutkowski et al. |
| 8,899,554 | B2 | 12/2014 | Wong et al. |
| 9,234,342 | B1 | 1/2016 | Beesley et al. |
| 9,260,847 | B2 | 2/2016 | Silverman et al. |
| 2002/0083538 | A1 | 7/2002 | Silverman et al. |
| 2002/0189038 | A1 | 12/2002 | Silverman |
| 2005/0173277 | A1 | 8/2005 | Rich |
| 2008/0098544 | A1 | 5/2008 | Rutkowski et al. |
| 2008/0148503 | A1 | 6/2008 | Babb et al. |
| 2008/0244816 | A1 | 10/2008 | Babb et al. |
| 2009/0292502 | A1 | 11/2009 | Gress et al. |
| 2010/0127922 | A1 | 5/2010 | Sooy |
| 2010/0139696 | A1 | 7/2010 | Silverman et al. |
| 2011/0182656 | A1 | 7/2011 | Babb |
| 2014/0223679 | A1 | 8/2014 | Silverman et al. |
| 2017/0165723 | A1 | 6/2017 | Banholzer et al. |
| 2017/0284078 | A1 | 10/2017 | Puzio et al. |

OTHER PUBLICATIONS

Mytana, "M500 User Guide," available in 2009, 4 pages.

Ridgid, "K-45 Drain Cleaning Machine Manual," available in 2012, 55 pages.

Ridgid, "K-45 Drain Cleaning Machine Parts List," available in 2012, 2 pages.

* cited by examiner

DRAIN CLEANER

CROSS-REFERENCE TO RELATED APPLICATIONS

This application is a continuation of application Ser. No. 15/862,360, filed Jan. 4, 2018, which is a continuation of application Ser. No. 15/426,762, filed Feb. 7, 2017, now U.S. Pat. No. 9,884,353, which is a continuation of International Application No. PCT/US2016/065942, filed Dec. 9, 2016, which claims priority to U.S. Provisional Application No. 62/264,916, filed Dec. 9, 2015, and to U.S. Provisional Application No. 62/296,453, filed Feb. 17, 2016, the entire contents of all of which are incorporated by reference herein.

FIELD OF INVENTION

The present invention relates to drain cleaners and to storage containers for drain cleaners.

BACKGROUND

Drain cleaners are commonly sold in plastic cases, such as reclosable blow-molded cases that are shaped to match the drain cleaners. The cases are used to carry the drain cleaners from job to job when not in use. However, these cases can be expensive. In addition, these cases may not have been designed specific to a particular user and application. Also, the cases tend to have crevices that are difficult to clean, and the drain cleaners tend to leave behind residue that is messy and smells if not cleaned.

In addition, drain cleaners can be difficult to use in tight spaces. The drum of a drain cleaner rotates to direct the cable into a drain to clean the drain. When the drain cleaner is used in a tight space, the drum may contact various surfaces. The rotation of the drum can damage these surfaces. Furthermore, the rotation of the drum may be problematic for a user. The rotation of the drum can cause damage to a user's hand. In addition, it may be difficult for a user to grasp the drain cleaner with a second hand to support the drain cleaner because the rotation of the drum interferes.

SUMMARY

In one embodiment, the invention provides a drain cleaner including a handle assembly including a grip, a motor positioned within the handle assembly, and an actuator supported by the handle assembly adjacent the grip. The actuator is electrically coupled to the motor and operable to selectively energize the motor. The drain cleaner also includes a shroud fixed to and extending forwardly from the handle assembly. The shroud includes a closed end adjacent the handle assembly. The drain cleaner further includes a drum assembly rotatably coupled to the handle assembly and positioned within the shroud. The drum assembly is operable to be rotated by the motor relative to the handle assembly and the shroud. The drain cleaner also includes a flexible cable stored within the drum assembly. The flexible cable is configured to be extended out of the drum assembly and into a drain.

In another embodiment, the invention provides a storage container for a drain cleaner. The storage container includes a bucket configured to receive the drain cleaner. The bucket includes a bottom and a sidewall extending upward from the bottom, where the sidewall defines an inner perimeter. The storage container further includes an insert positioned within the bucket. The insert includes a base disposed on the bottom of the bucket. The base includes an outer perimeter that is sized and shaped to correspond to the inner perimeter of the sidewall of the bucket. The insert further includes a plurality of projections extending upwardly from the base. The plurality of projections is spaced apart on the base and is configured to support the drain cleaner above the bottom of the bucket.

In yet another embodiment, the invention provides a system including a drain cleaner having a handle assembly with a grip, a motor positioned within the handle assembly, and an actuator supported by the handle assembly adjacent the grip. The actuator is electrically coupled to the motor and operable to selectively energize the motor. The drain cleaner also includes a drum assembly rotatably coupled to the handle assembly. The drum assembly is operable to be rotated by the motor relative to the handle assembly. The drain cleaner further includes a flexible cable stored within the drum assembly. The flexible cable is configured to be extended out of the drum assembly and into a drain. The system further includes a storage container having a bucket that receives the drain cleaner. The bucket includes a bottom and a sidewall extending upward from the bottom, where the sidewall defines an inner perimeter. The storage container also includes an insert positioned within the bucket. The insert includes a base disposed on the bottom of the bucket. The base includes an outer perimeter that is sized and shaped to correspond to the inner perimeter of the sidewall of the bucket. The insert further includes a plurality of projections extending upwardly from the base. The plurality of projections engages a portion of the drain cleaner to support the drain cleaner above the bottom of the bucket.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
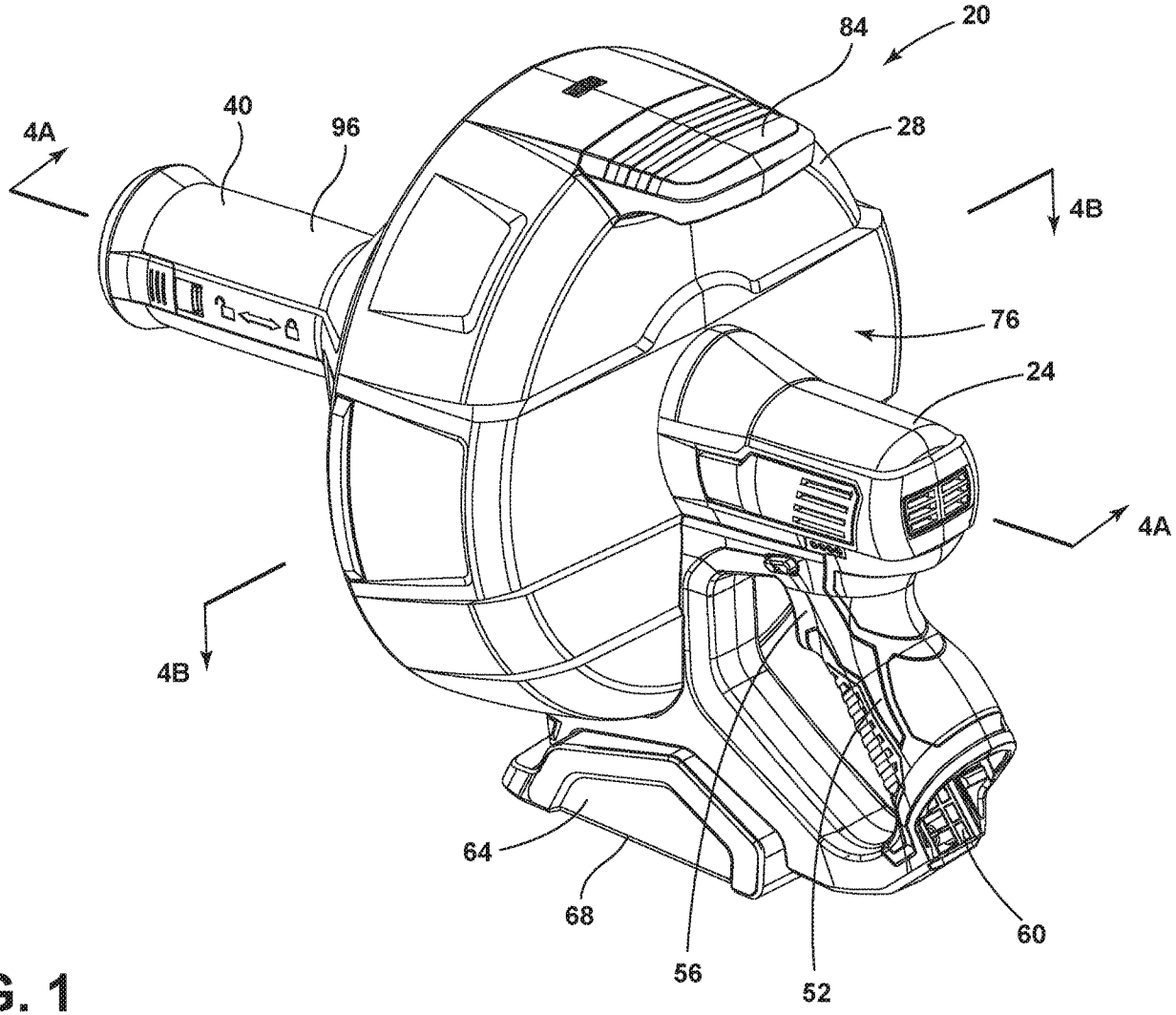
FIG. 1 is a rear perspective view of a drain cleaner according to one embodiment.
Figure 2:
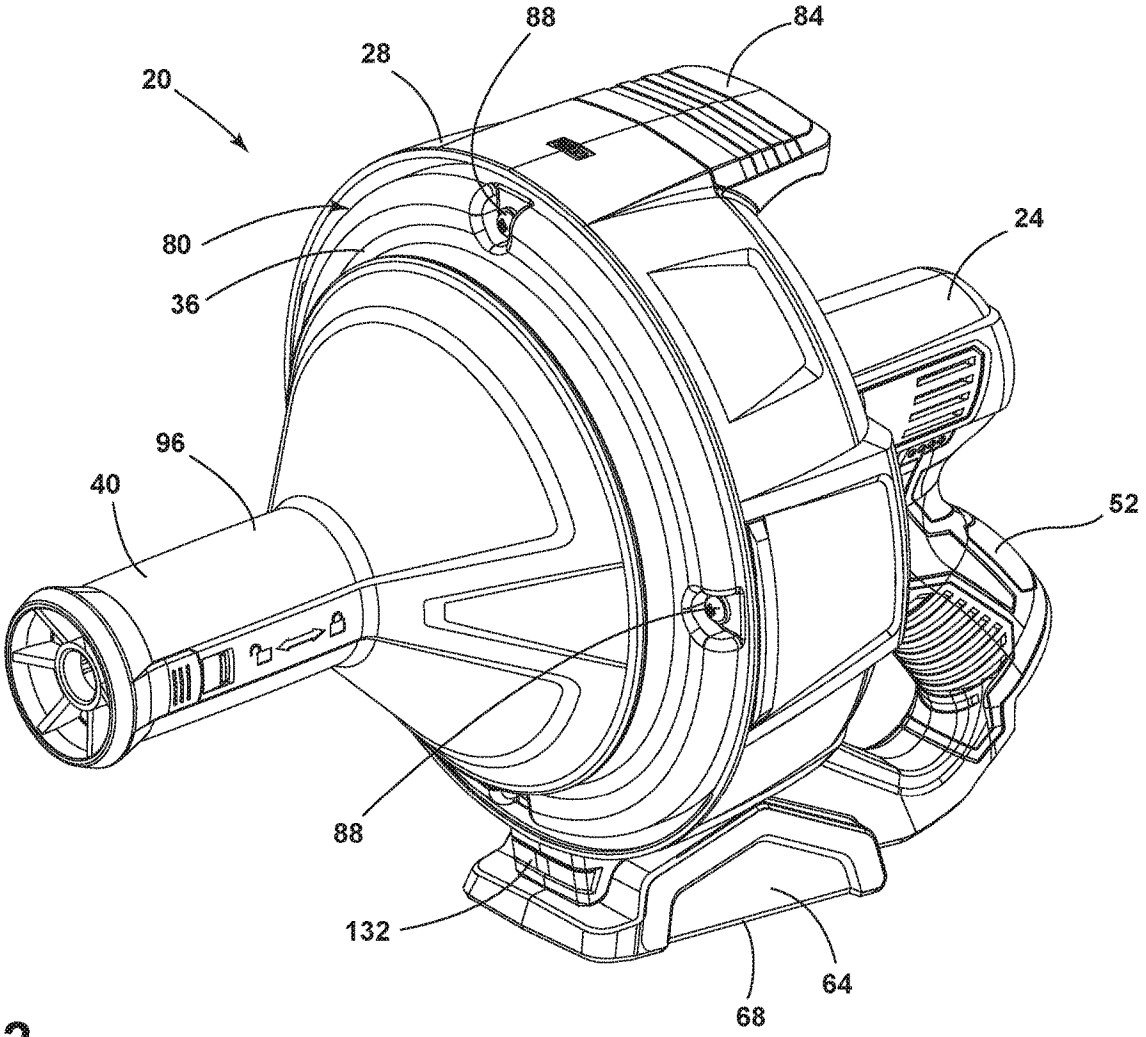
FIG. 2 is a front perspective view of the drain cleaner shown in FIG. 1.
Figure 3:
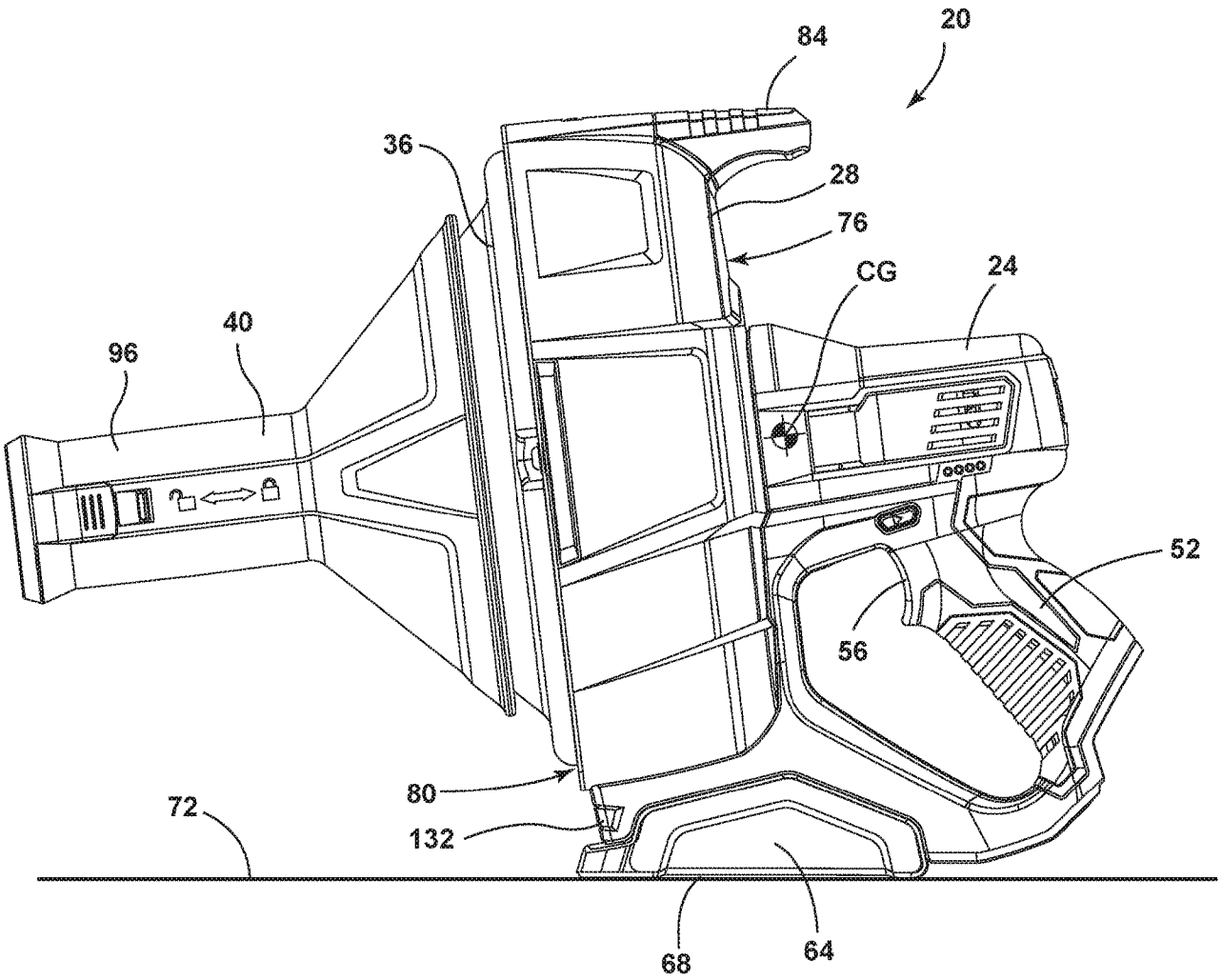
FIG. 3 is a side view of the drain cleaner shown in FIG. 1.
Figure 4A:
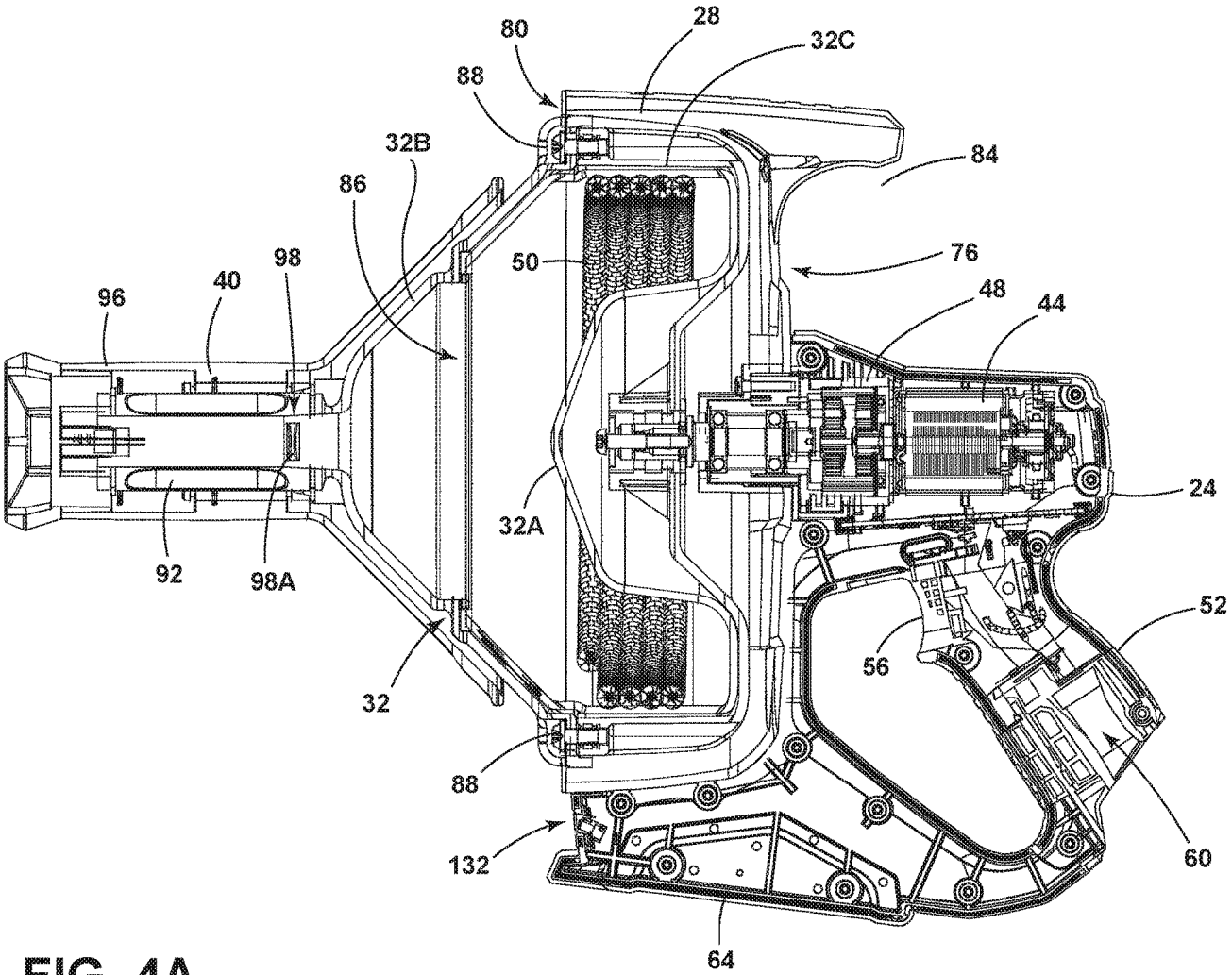
FIG. 4A is a cross-sectional view of the drain cleaner taken along section line 4A-4A of FIG. 1.
Figure 4B:
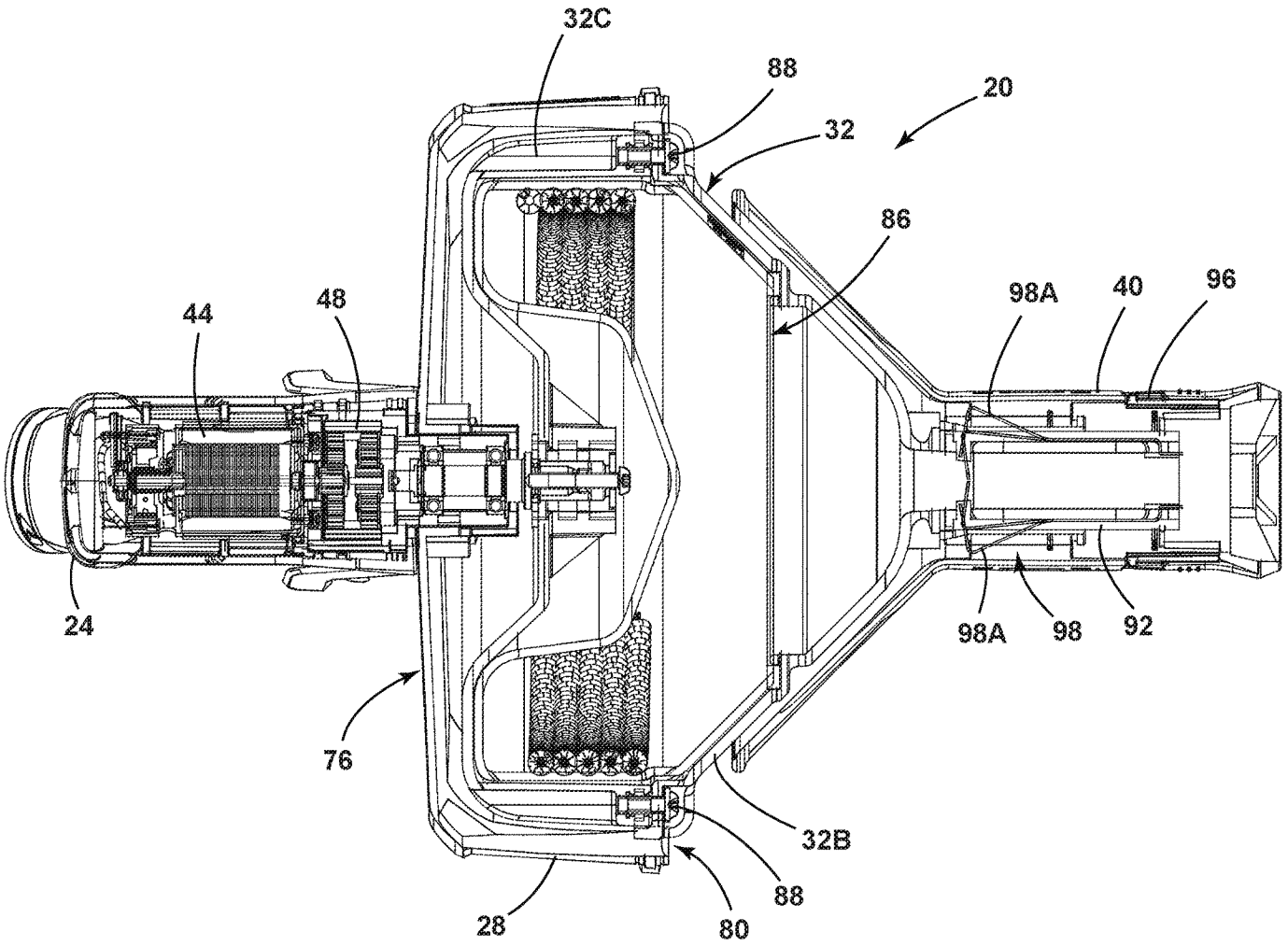
FIG. 4B is a cross-sectional view of the drain cleaner taken along section line 4B-4B of FIG. 1.

FIGS. 1-4B illustrate a drain cleaner 20. The illustrated drain cleaner 20 includes a handle assembly 24, a shroud 28, a drum assembly 32, and a nose assembly 40. In one embodiment, the shroud 28 may be a drum shield. As shown in FIGS. 4A and 4B, the drain cleaner 20 also includes a motor 44 and a drive mechanism 48 positioned within the handle assembly 24. The drain cleaner 20 further includes a flexible cable 50 that is stored within the drum assembly 32 and extends out of the nose assembly 40. The cable 50 is insertable into a drain, or other conduit, for cleaning the drain. In some embodiments, the cable 50 may include an auger head or other tool attachment at its distal end.

The handle assembly 24 extends rearwardly from the shroud 28. The handle assembly 24 includes a grip 52 that is configured to be grasped by a user for carrying and operating the drain cleaner 20. The handle assembly 24 supports an actuator 56 (e.g., a trigger) adjacent the grip 52. The actuator 56 is actuatable (e.g., depressible) by a user to selectively energize the motor 44 and, thereby, operate the drain cleaner 20. The illustrated handle assembly 24 also includes a battery receptacle 60 for receiving and supporting a battery pack, such as a power tool battery pack. The battery receptacle 60 includes terminals that electrically connect the battery pack to the motor 44 and the actuator 56. In other embodiments, the handle assembly 24 may support a power cord to electrically connect the motor 44 to an AC power source.

As shown in FIG. 3, the illustrated handle assembly 24 further includes a stand 64. In one embodiment, the stand 64 is a base. The stand 64 is positioned generally beneath the shroud 28 and the motor 44. More particularly, the stand 64 is positioned beneath a center of gravity CG of the drain cleaner 20, which is principally defined by the motor 44, the drive mechanism 48, the cable 50, and the battery pack (if present) of the drain cleaner 20. The stand 64 includes a generally planar surface 68 that is configured to engage and rest on a support surface 72 (e.g., a table, a workbench, a countertop, the floor, etc.). In one embodiment, the stand 64 may provide ease of use during operation. The stand 64 supports the drain cleaner 20 in an upright position (as illustrated in FIG. 3) with the nose assembly 40 spaced apart from the support surface 72.

Referring back to FIGS. 1-3, the shroud 28 is coupled to the handle assembly 24 generally above the stand 64. The illustrated shroud 28 is generally cup-shaped and includes a closed end 76 adjacent or facing the handle assembly 24 and an open end 80 adjacent or facing the drum cover 32B. The shroud 28 is fixed to the handle assembly 24 such that the shroud 28 is stationary (i.e., does not rotate or otherwise move) relative to the handle assembly 24 during operation of the drain cleaner 20. The shroud 28 is positioned around the drum assembly 32 to help protect the drum assembly 32. The shroud 28 also inhibits the drum assembly 32 from contacting surrounding structures or surfaces, allowing the drain cleaner 20 to be used in relatively tight spaces without the drum assembly 32 contacting and potentially marring the surrounding structures or surfaces as it rotates. Further, the shroud 28 protects a user from the spinning drum assembly 32, and provides ease of use if the user supports the drain cleaner 20 with his/her body during operation (e.g., rests the drain cleaner 20 on a knee or hip). In the illustrated embodiment, the shroud 28 includes a carrying handle 84. The carrying handle 84 extends rearwardly from an upper side of the shroud 28 (i.e., from a side of the shroud 28 opposite the stand 64). The carrying handle 84 facilitates lifting and carrying the drain cleaner 20 when not in use. In some embodiments, the handle 84 may be omitted.

As shown in FIGS. 4A and 4B, the drum assembly 32 is positioned substantially within the shroud 28. The illustrated drum assembly 32 includes an inner drum 32A, a drum cover 32B, and a drum support 32C. The inner drum 32A is configured to support the cable 50 of the drain cleaner 20. The inner drum 32A is positioned at least partially within the drum support 3C and includes an open forward end 86. The drum cover 32B extends over the open forward end 86 of the inner drum 32A. The drum cover 32B is also coupled to the drum support 32C. In the illustrated embodiment, the drum cover 32B is coupled to the drum support 32C with threaded fasteners 88 (e.g., screws). The threaded fasteners 88 allow the drum cover 32B to be removed from the drum support 32C for replacing and/or cleaning the cable 50 and inside of the drum assembly 32. When the drum cover 32B is secured to the drum support 32C, the inner drum 32A is captured or sandwiched between the drum cover 32B and the drum support 32C so that the entire drum assembly 32 moves (e.g., rotates) together. In other embodiments, the drum cover 32B may be coupled to the drum support 32C with other suitable coupling means.

The drum support 32C is coupled to the drive mechanism 48 such that rotation of the motor 44 is transmitted to the drum assembly 32 through the drive mechanism 48. Friction between the inner surface of the inner drum 32A and the cable 50 causes the cable 50 to rotate or spin with the drum assembly 32. As the drum assembly 32 rotates, the cable 50 also rotates, causing the cable 50 to be extended into the drain or retracted from the drain. The illustrated drive mechanism 48 includes a gear train having, for example, planetary gear arrangements and an output shaft that transmit rotation of the motor 44 to the drum support 32C. In the illustrated embodiment, the drum support 32C is threadably coupled to the output shaft of the drive mechanism 48. In other embodiments, the drum support 32C may be coupled to the drive mechanism 48 using other suitable means to transmit force (e.g., rotation) from the drive mechanism 48 to the drum assembly 32. Additionally, in some embodiments, other suitable drive mechanisms may also or alternatively be employed.

With continued reference to FIGS. 4A and 4B, the illustrated drum cover 32B includes an extended portion 92 that extends away from the drum assembly 32 and into the nose assembly 40. The extended portion 92 guides the cable 50 from the drum assembly 32 out of the drain cleaner 20. The nose assembly 40 is positioned forward of the shroud 28 and provides a second grip 96 for a user to hold the drain cleaner 20 during operation. For example, a user can grasp the grip 52 of the handle assembly 24 with one hand to operate the actuator 56, and can grasp the second grip 96 of the nose assembly 40 with the other hand to help guide the drain cleaner 20.

The illustrated nose assembly 40 also provides a lock mechanism 98 for the drain cleaner 20. In particular, the nose assembly 40 is slidable toward and away from the drum assembly 32 to selectively lock and unlock the cable 50, respectively. In the illustrated embodiment, the lock mechanism 98 includes two spring clips 98A positioned within the nose assembly 40 on opposite sides of the extended portion 92 of the drum cover 32B. When the nose assembly 40 is slid toward the drum assembly 32, the spring clips 98A are pushed inwardly to engage the cable 50. In this position, the cable 50 is forced to rotate with the drum assembly 32 since the spring clips 98A move with the extended portion 92 of the drum cover 32B. When the nose assembly 40 is slid away from the drum assembly 32, the spring clips 98A are biased apart from each other and disengage the cable 50 so that the cable 50 can be fed out of or into the drum assembly 32. In some embodiments, the nose assembly 40 may be biased away from the drum assembly 32 (i.e., toward an unlocked position) by a spring or other biasing member. Although the illustrated nose assembly 40 slides axially between engaged and disengaged positions, in other embodiments, the nose assembly 40 may rotate between the engaged and disengaged positions.

As shown in FIGS. 2-4A, the drain cleaner 20 also includes a light 132. The illustrated light 132 is supported by the handle assembly 24 between the shroud 28 and the stand 64. The light 132 is also electrically coupled to the battery pack (or other power source of the drain cleaner 20) through the actuator 56. When the actuator 56 is depressed by a user to rotate the drum assembly 32, the light 132 is also powered to illuminate an area in front of the drain cleaner 20. In some embodiments, the light 132 may include a light emitting diode (LED) or LED array. In other embodiments, other suitable lights may be employed.

Figure 5:
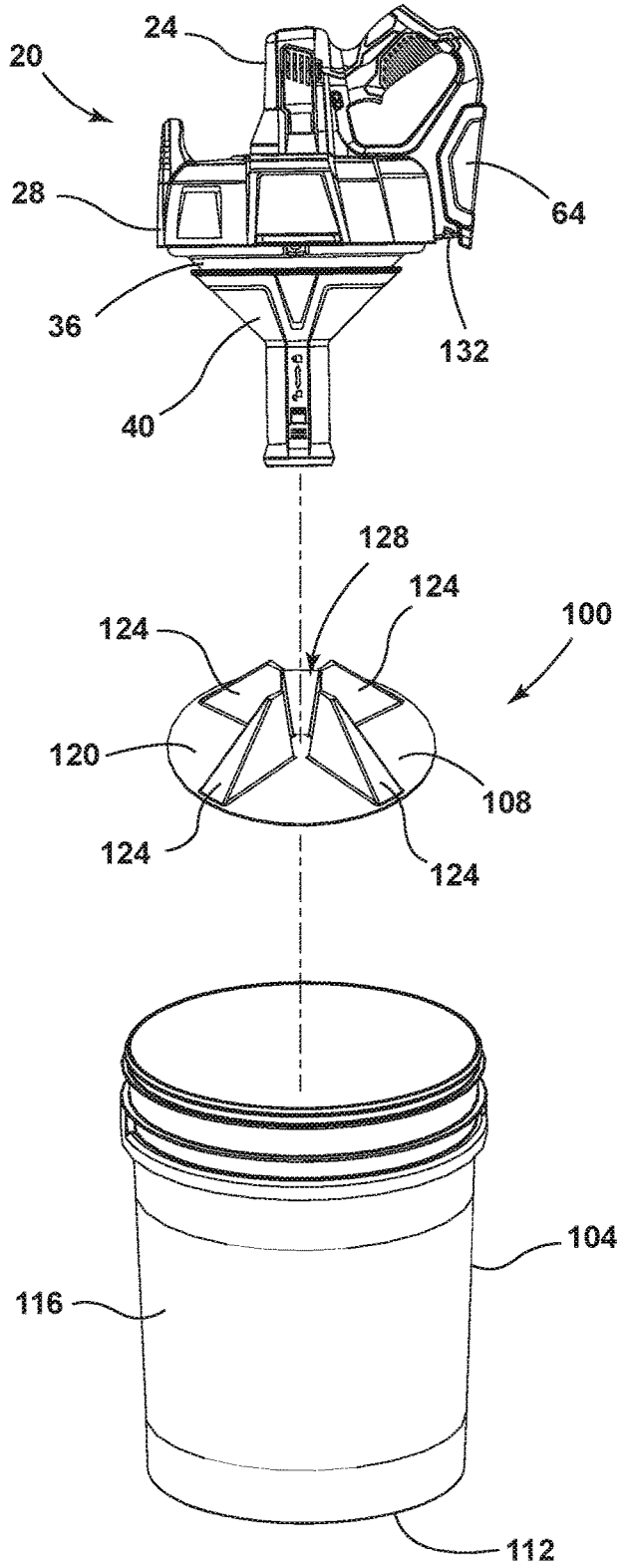
FIG. 5 is an exploded perspective view of the drain cleaner shown in FIG. 1 and a storage container.
Figure 7:
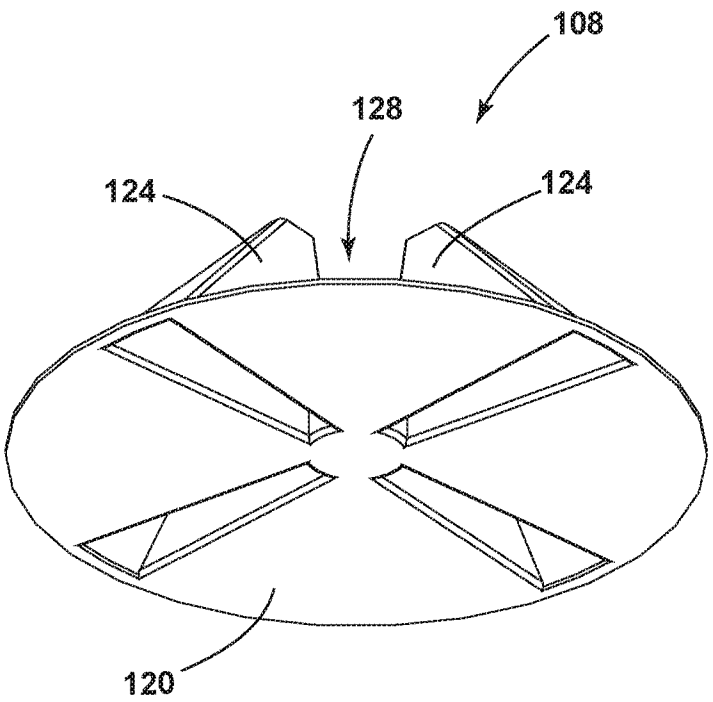
FIG. 7 is a bottom perspective view of the insert shown in FIG. 6.
Figure 6:
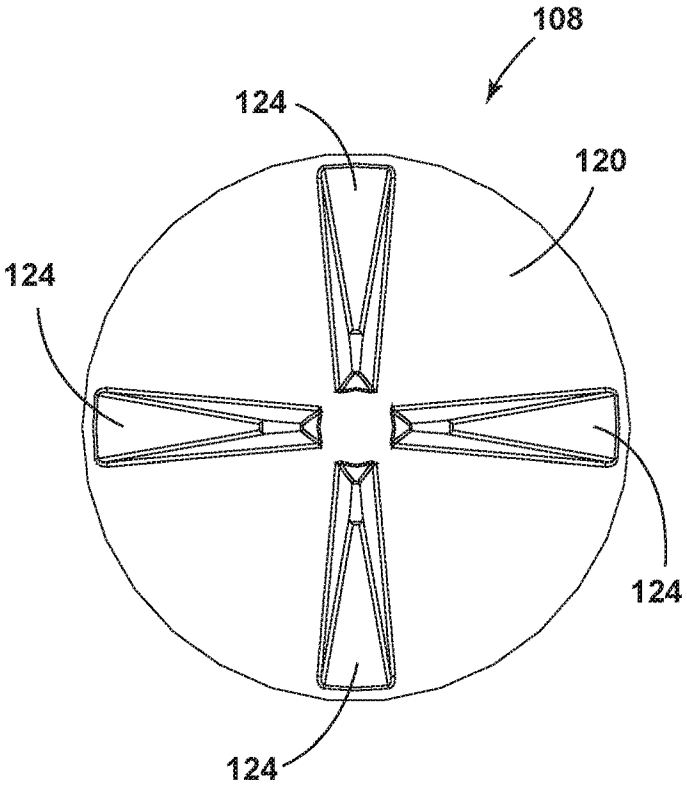
FIG. 6 is a top view of an insert for use with the storage container shown in FIG. 5.

FIG. 5 illustrates a storage container 100 for the drain cleaner 20. The illustrated storage container 100 includes a bucket 104 and an insert 108. The bucket 104 is, for example, a 5-gallon bucket having a bottom 112 and a generally cylindrical sidewall 116. In other embodiments, the storage container 100 may include different sized and/or shaped open-topped containers. For example, the bucket 104 may be a container having a rectangular-, oval-, or polygonal-shaped sidewall. In some embodiments, the bucket 104 (or other container) may also include a handle for carrying the bucket 104. Furthermore, a lid may be selectively coupled to an upper edge of the sidewall 116 to enclose the bucket 104 (or other container). The bucket 104 is configured to receive the drain cleaner 20 for storing and/or transporting the drain cleaner 20. In some embodiments, the bucket 104 may also be sold with the drain cleaner 20 as the carrying case for the drain cleaner 20. In one embodiment, the storage bucket 104 may be designed to accommodate specific users to reduce mess and allow for storage and transport of a drain cleaner, as well as additional tools and/or accessories that may be used during a drain cleaning operation in conjunction with the drain cleaner (e.g., locking pliers, rags, etc.).

The insert 108 is positionable inside the bucket 104 to help support the drain cleaner 20 within the bucket 104. The insert 108 includes a base 120 and a plurality of projections 124 extending upward from the base 120. The base 120 is planar, with a generally flat top surface and bottom surface. The flat bottom surface of the base 120 enables the base 120 to sit flat on the inside of the bucket 104. The base 120 has an outer perimeter that corresponds to an inner perimeter of the wall 116 of the bucket 104. The illustrated insert 108 includes a circular base 120 and four projections 124 extending perpendicularly from the base 120. In the illustrated embodiment, the circular base 120 and the projections 124 are integrally formed as a single piece of plastic. In other embodiments, the insert 108 may include fewer or more projections 124, the base 120 and the projections 124 may be formed as separate pieces that are coupled together, and/or the insert 108 may be formed of other material(s). The circular base 120 generally corresponds to the shape and size of the bottom 112 of the bucket 104. The projections 124 are circumferentially spaced evenly around the circular base 120. The illustrated projections 124 are generally triangular in shape and taper in height from the center of the base 120 toward the outer perimeter of the base 120. The projections 124 are configured to engage the nose assembly 40 of the drain cleaner 20 to support the drain cleaner 20 above the bottom 112 of the bucket 104. A central gap 128 formed between the projections 124 at the center of the base 120 provides clearance for a cable of the drain cleaner 20 when the drain cleaner 20 is supported by the insert 108. In one embodiment, this configuration may tend to prevent or deter damaging or bending of a cable tip while allowing the tool to rest upside-down in a bucket to allow draining of liquid or debris from the tool after use.

In the illustrated embodiment, the insert 108 is free floating within the bucket 104. This arrangement allows the insert 108 to be easily removed from the bucket 104 for cleaning. In other embodiments, the insert 108 may be releasably secured to the bucket 104. In further embodiments, the insert 108 may be permanently secured to the bottom 112 of the bucket 104, or the projections 124 of the insert 108 may be integrally formed in the bottom 112 of the bucket 104. As noted above, the bucket 104 may be replaced with a different sized or shaped container, in which case the insert 108 may be correspondingly shaped and sized to fit within the container and support the drain cleaner 20 above the bottom of the container.

Figure 8:
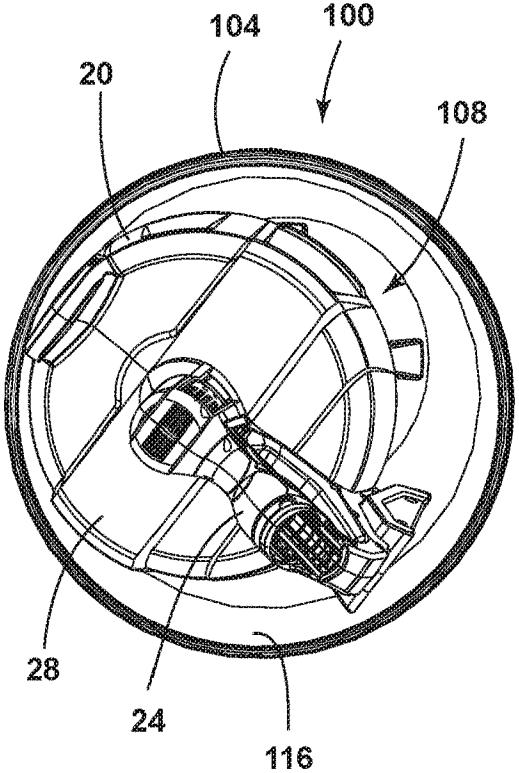
FIG. 8 is a top view of the drain cleaner positioned within the storage container.

FIG. 8 illustrates the drain cleaner 20 positioned within the bucket 104 for storage or sale. The insert 108 is positioned at the bottom 112 of the bucket 104 and contacts the nose assembly 40 of the drain cleaner 20 to support the drain cleaner 20 above the bottom 112 of the bucket 104.

Figure 9:
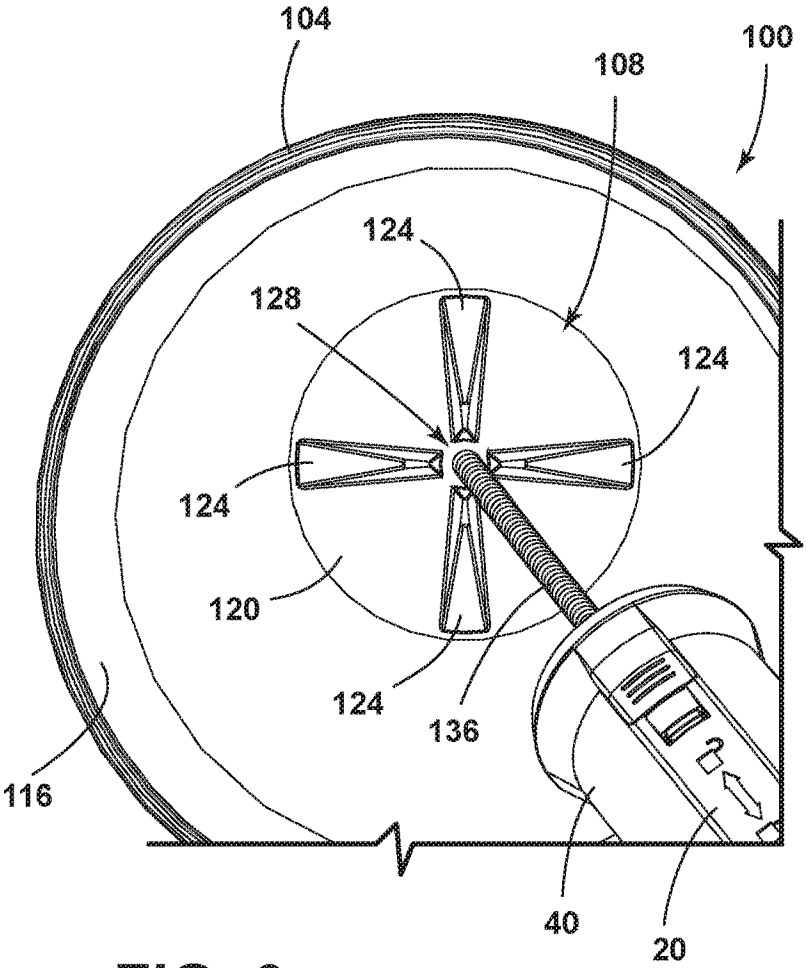
FIG. 9 is a detailed view of the drain cleaner being removed from the storage container.

FIG. 9 illustrates the storage container 100 with the drain cleaner 20 removed. The insert 108 is positioned at the bottom 112 of the bucket 104. A cable 136 extends from the nose assembly 40 of the drain cleaner 20. The insert 108 provides clearance for a distal end section 140 of the cable 136 so that the cable 136 is not unintentionally bent or otherwise deformed while the drain cleaner 20 is stored within the bucket 104.

Figure 10:
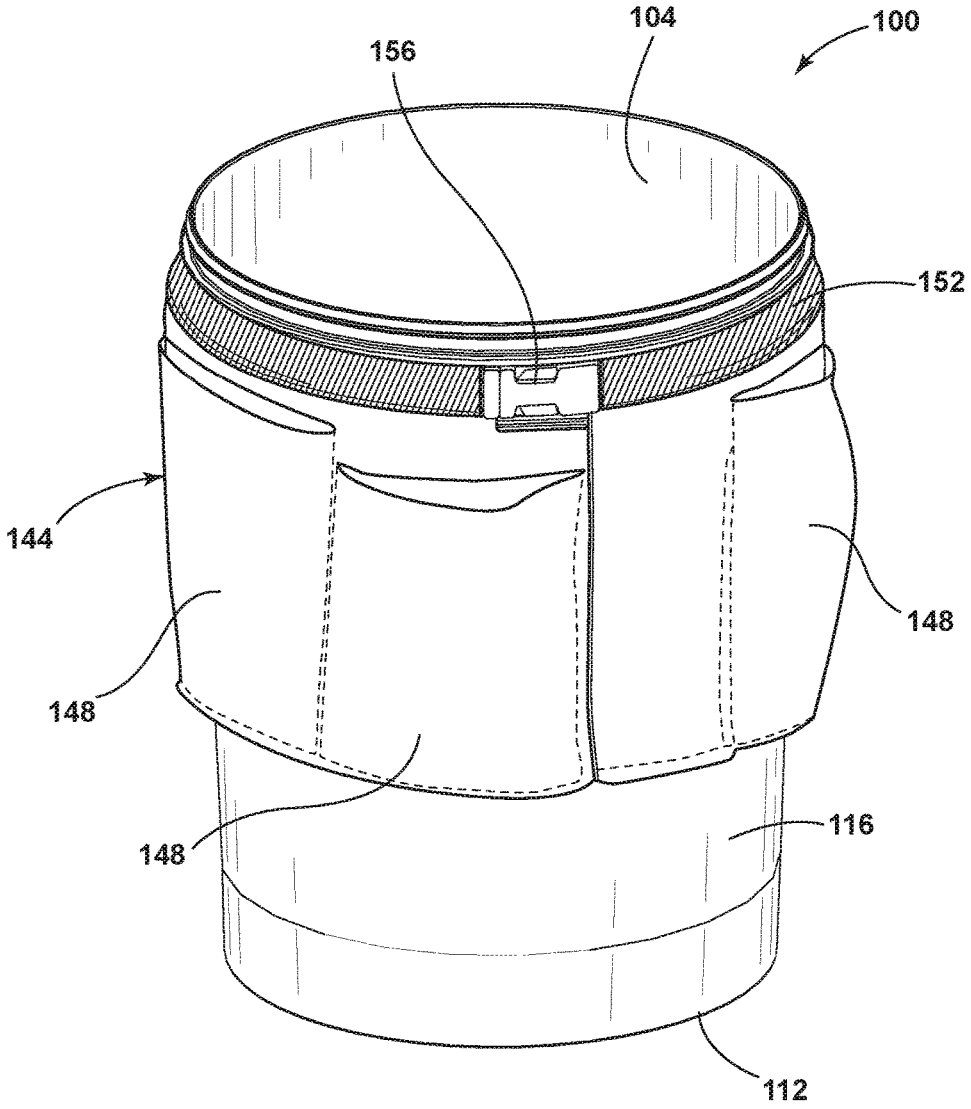
FIG. 10 is a perspective view of the storage container shown in FIG. 5, the storage container including an apron.
Figure 11:
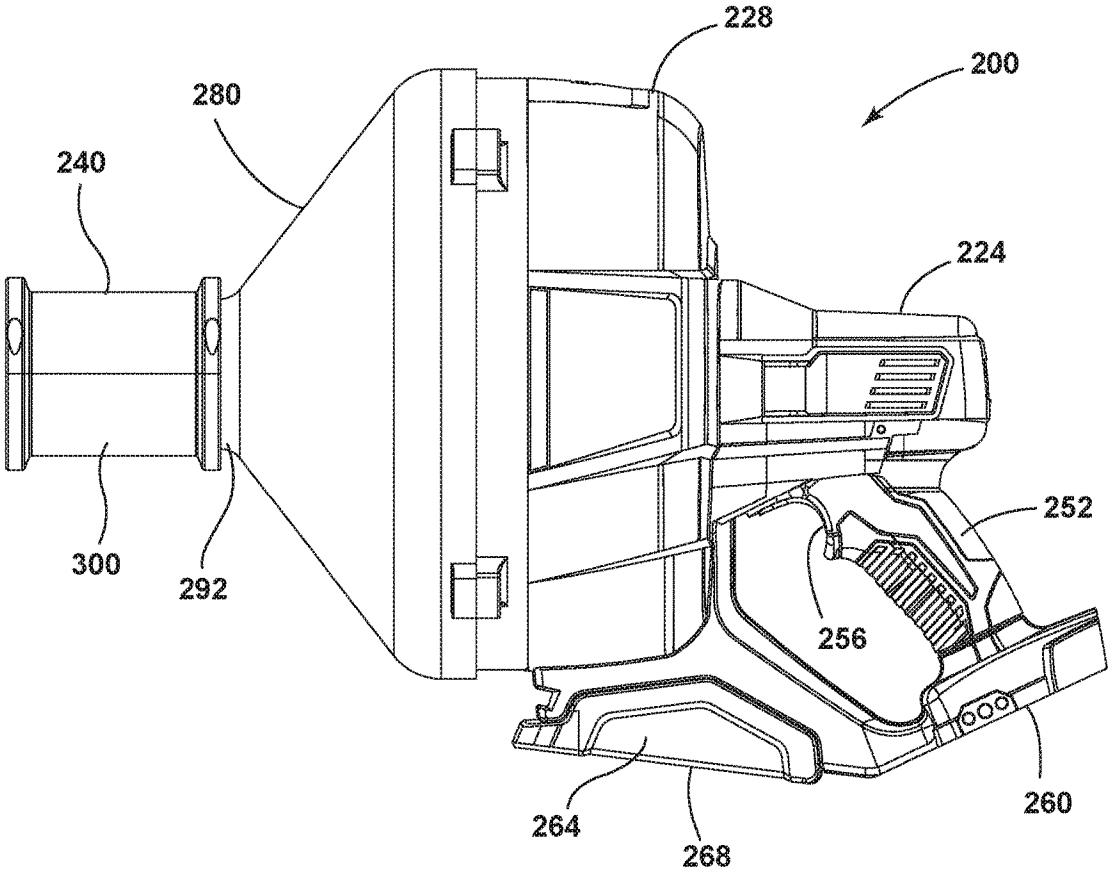
FIG. 11 is a side view of a drain cleaner according to another embodiment.

FIG. 10 illustrates the storage container 100 with a shroud or apron 144 (e.g., a bucket organizer wrap) coupled to the bucket 104. The apron 144 may be made of a fabric material, such as canvas. In another embodiment, the apron 144 is made from polyester or nylon. In other embodiments, other suitable materials may be used. The apron 144 wraps around the sidewall 116 of the bucket 104 and includes pockets 148 for storing items associated with the drain cleaner 20 (e.g., battery packs, cable attachments, brushes, etc.). In the illustrated embodiment, the apron 144 also includes a belt 152 that tightly engages the bucket 104 to suspend the apron 144 from the bucket 104. Ends of the belt 152 are secured together by a buckle 156 so that the apron 144 is removable from the bucket 104. In other embodiments, the ends of the belt 152 may be secured together with loops, snaps, Velcro, or the like. In further embodiments, the apron 144 may include hooks that extend over an upper edge of the bucket 104 to suspend the apron 144 from the bucket 104. In each of these embodiments, none of the apron 144 extends inside the bucket 104, which reduces the possibility of soiling the apron 144.

FIGS. 11-14 illustrate another drain cleaner 200 that is similar to the drain cleaner 20 discussed above. In the illustrated embodiment, the drain cleaner 200 includes a handle assembly 224, a shroud 228, a drum 232, and a nose assembly 240. The drain cleaner 200 also includes a motor 244 and a drive mechanism 248 positioned within the handle assembly 224. The drain cleaner 200 further includes a flexible cable (not shown) that is stored within the drum 232 and extends out of nose assembly 240. The cable is insertable into a drain, or other conduit, for cleaning the drain.

The handle assembly 224 includes a grip 252 that is configured to be grasped by a user for carrying and operating the drain cleaner 200. The handle assembly 224 supports an actuator 256 (e.g., a trigger) adjacent the grip 252. The actuator 256 is actuatable by a user to selectively energize the motor 244 and, thereby, operate the drain cleaner 200. The illustrated handle assembly 224 also includes a battery receptacle 260 for receiving and supporting a battery pack.

The handle assembly 224 further includes a stand 264. In the illustrated embodiment, the stand 264 is positioned generally beneath the shroud 228 and the motor 244. More particularly, the stand 264 is positioned beneath a center of gravity of the drain cleaner 200, which is principally defined by the motor 244, the drive mechanism 248, the cable, and the battery pack (if present) of the drain cleaner 200. The stand 264 includes a generally planar surface 268 that is configured to engage and rest on a support surface. The stand 264 supports the drain cleaner 200 in an upright position with the nose assembly 240 spaced apart from the support surface.

The shroud 228 is coupled to the handle assembly 224 generally above the stand 264. The illustrated shroud 228 is generally cup-shaped and includes a closed end 276 adjacent or facing the handle assembly 224. The shroud 228 is fixed to the handle assembly 224 such that the shroud 228 is stationary (i.e., does not rotate or otherwise move) relative to the handle assembly 224 during operation of the drain cleaner 200. The shroud 228 is positioned around the drum 232 to help protect the drum 232. The shroud 228 allows the drain cleaner 200 to be used in relatively tight spaces without the drum contacting surrounding structures. The shroud 228 also protects a user from the spinning drum assembly 232.

The drum 232 is positioned substantially within the shroud 228. The drum 232 is rotatably driven by the motor 244, which in turn, rotates the cable. Specifically, the drum 232 rotates within and relative to the shroud 228. The motor 244 and the drive mechanism 248 are nested within a cavity 242 formed within the center of the drum 232. The cable is coiled around the outside of the cavity 242 while the motor 244 and drive mechanism 248 engage with the drum 232 from the inside of the cavity 242.

The illustrated drain cleaner 200 further includes an outer shield 280. The outer shield 280 is fixed to a shroud 228 of the drain cleaner 200 to completely enclose the drum 232. In some embodiments, a seal 246 is formed between the shroud 228 and the shield 280 to seal in water. The seal 246 can be formed by an elastomer, plastic, or any other known material capable of forming a water tight connection between the shroud 228 and the shield 280. The outer shield 280 also forms part of the nose assembly 240 of the illustrated drain cleaner 200. By completely enclosing the rotating drum 232, the outer shield 280 facilitates working in enclosed spaces and inhibits inadvertent contact between the drum 232 and any fixtures, cabinets, or other nearby surfaces.

The nose assembly 240 includes an elongated portion 292 that guides the cable into the drain. In the illustrated embodiment, the elongated portion 292 of the nose assembly 240 is formed by the outer shield 280. Specifically, the outer shield 280 and the elongated portion 292 are formed as a continuous element. In other embodiments, the nose assembly 240 is a separate element from the outer shield 280.

Figure 12:
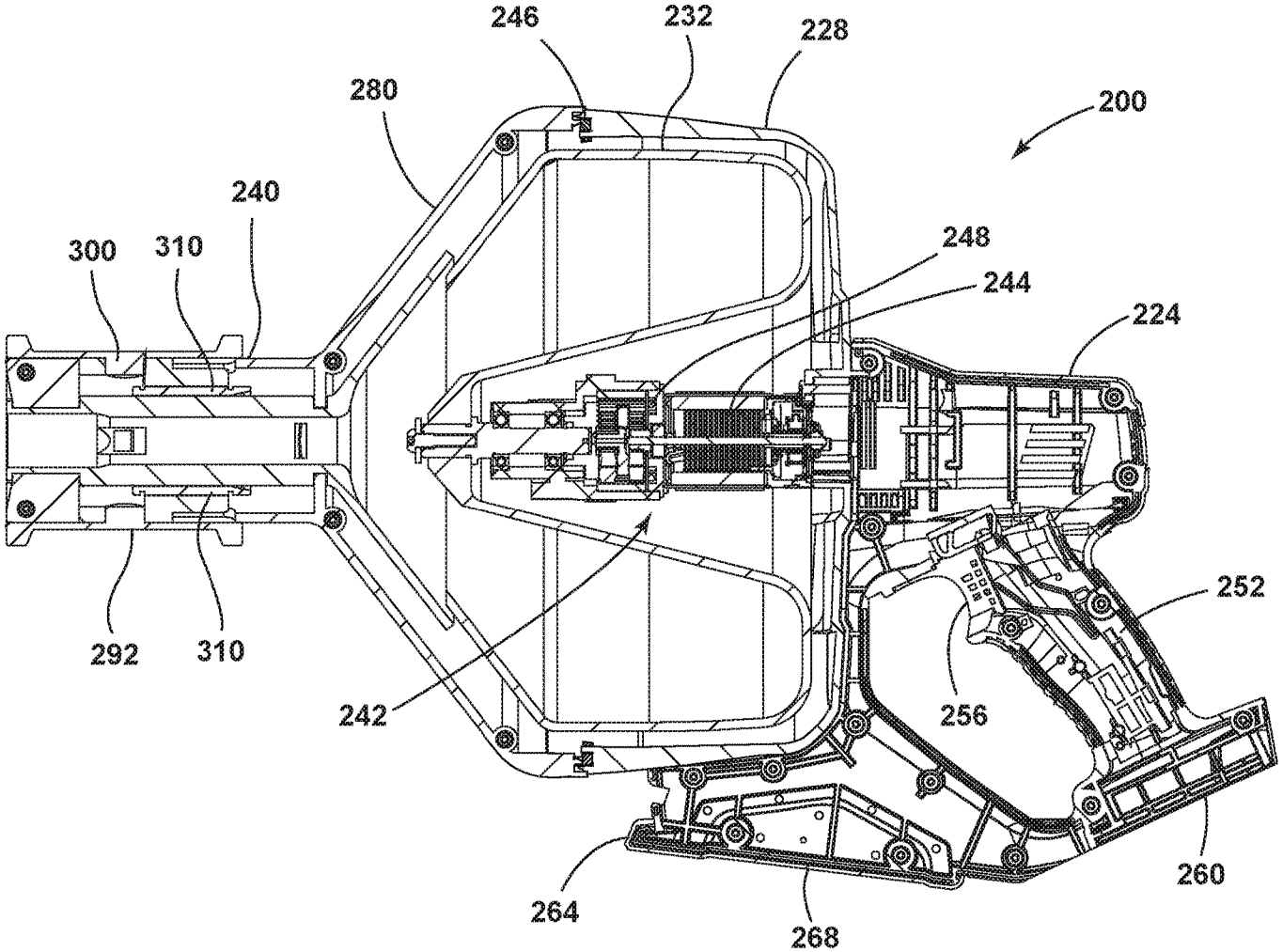
FIG. 12 is a cross-sectional view of the drain cleaner shown in FIG. 11, the drain cleaner including a cable lock mechanism in an unclamped position.
Figure 13:
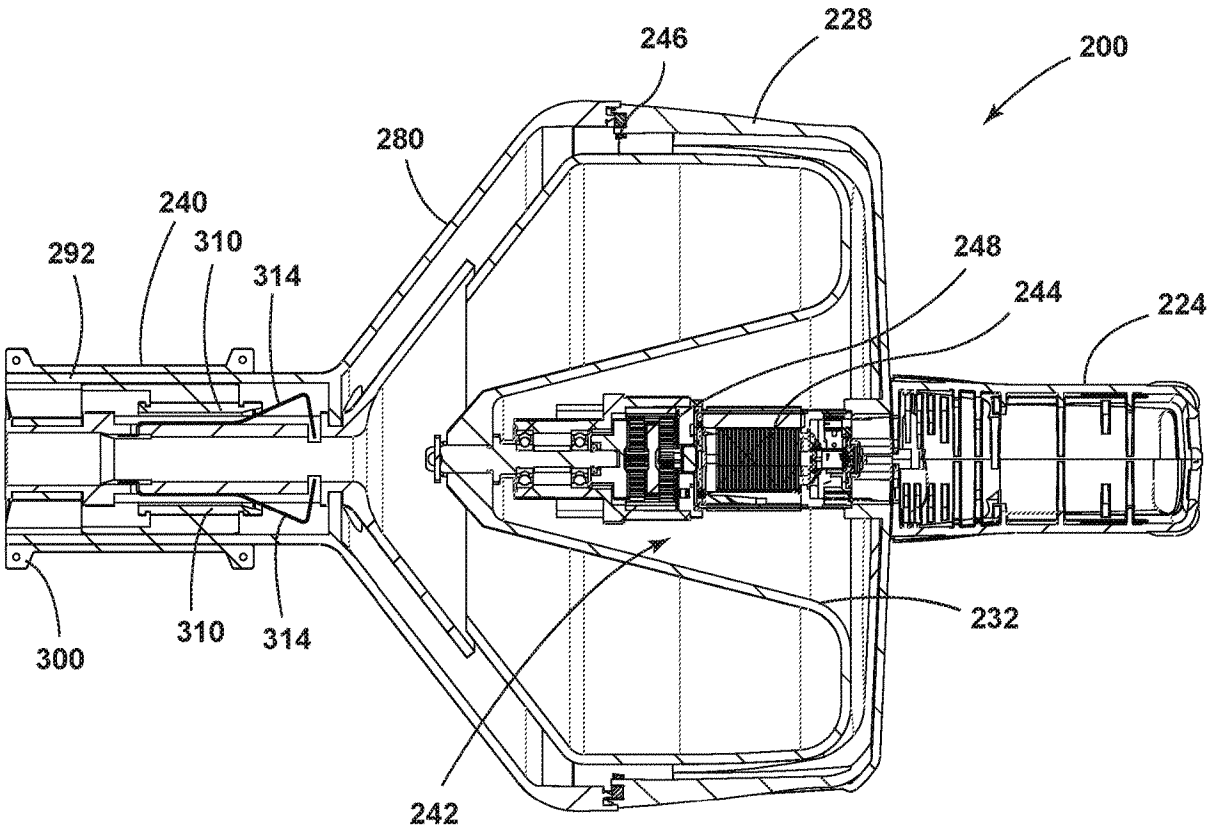
FIG. 13 is another cross-sectional view of the drain cleaner shown in FIG. 11 with the cable lock mechanism in the unclamped position.
Figure 14:
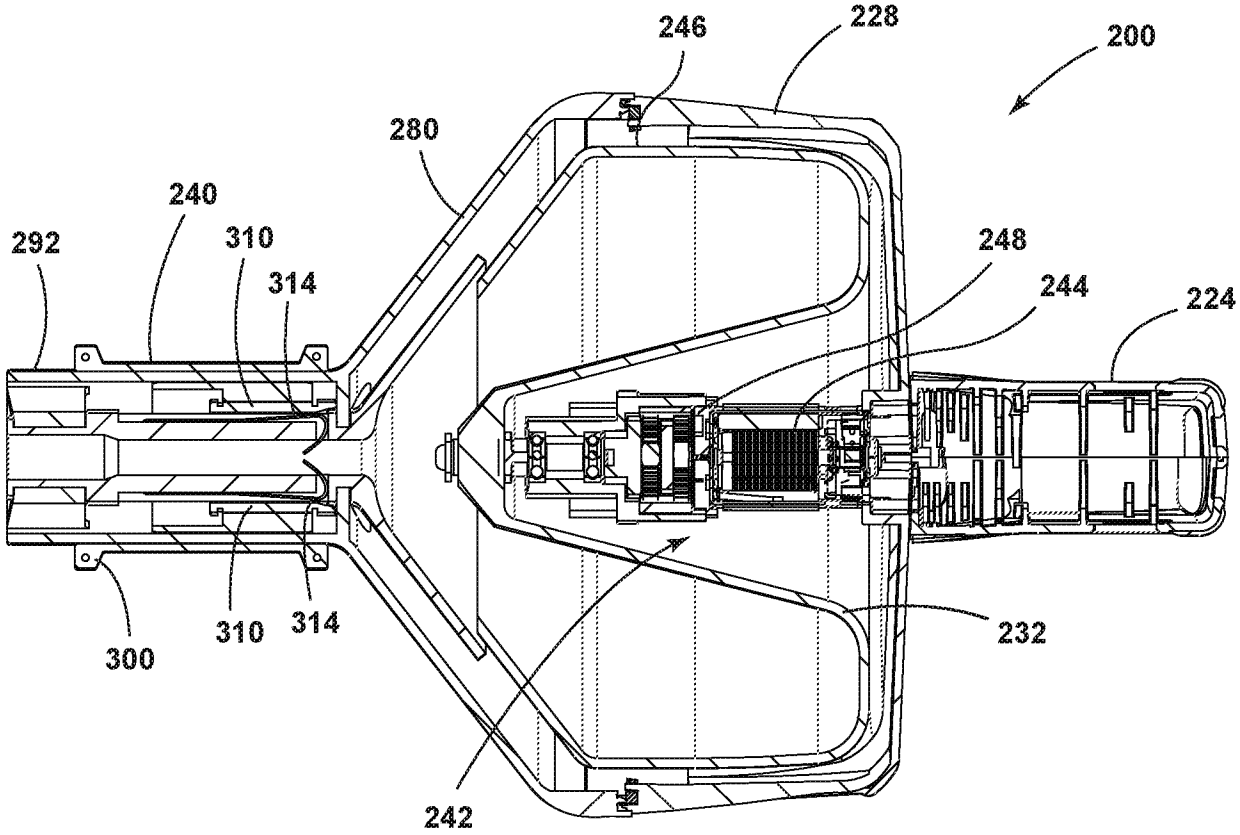
FIG. 14 is a cross-sectional view of the drain cleaner shown in FIG. 11 with the cable lock mechanism in a clamped position.

With reference to FIGS. 12-14, the illustrated drain cleaner 200 also includes a cable lock mechanism 300. The illustrated cable lock mechanism 300 is at least partially supported by the outer shield 280. The cable lock mechanism 300 is slidable along a portion of the nose assembly 240 between an unclamped position (FIGS. 12 and 13) and a clamped position (FIG. 14). The cable lock mechanism 300 includes a cam member 310 that is configured to engage spring clips 314 within the nose assembly 240. The spring clips 314 can selectively clamp the cable to limit or allow axial movement of the cable.

In the unclamped position, the cable lock mechanism 300 is slid forward along the outer shield 280 (i.e., away from a motor and drive mechanism 300 of the drain cleaner 200). In this position, the cam member 310 is not engaged with the spring clips 314. Accordingly, the spring clips 314 are in a neutral, unbiased position and are not engaged with the cable. Therefore, the cable is free to move. In the clamped position, the cable lock mechanism 300 is slid rearward along the outer shield 280 (i.e., toward the motor and drive mechanism 300 of the drain cleaner 200). Sliding the cable lock mechanism 300 in the rearward direction forces the cam members 310 to engage the spring clips 314, which biases the spring clips 314 radially inward. In this position, the spring clips 314 of the cable lock mechanism 300 are forced inward to engage the cable so the cable is clamped. In some embodiments, the cable lock mechanism 300 may be biased toward the unclamped position.

Although the invention has been described in detail with reference to certain preferred embodiments, variations and modifications exist within the scope and spirit of one or more independent aspects of the invention as described. Various features and advantages of the invention are set forth in the following claims.

The invention claimed is:

1. A drain cleaner comprising:

a shroud including a closed end and an open end opposite the closed end;

a drum assembly positioned within the shroud, the drum assembly being rotatable relative to the shroud;

a flexible cable stored within the drum assembly; and a handle assembly coupled to and extending rearwardly from the shroud, the handle assembly including a motor, a grip, and an actuator to selectively energize the motor, the actuator being positioned in an area defined between the grip and the shroud;

wherein the drum assembly encloses the flexible cable.

2. The drain cleaner of claim 1, further comprising a drive mechanism positioned within the handle assembly.

3. The drain cleaner of claim 2, wherein the drive mechanism transfers rotation from the motor to the drum assembly.

4. The drain cleaner of claim 1, wherein the handle assembly includes a battery receptacle configured to receive a battery pack.

5. The drain cleaner of claim 1, wherein the closed end of the shroud faces the handle assembly and the open end of the shroud faces away from the handle assembly.

6. The drain cleaner of claim 1, further comprising a base positioned beneath the shroud.

7. The drain cleaner of claim 6, further comprising a light supported by the base, wherein the light is electrically coupled to the actuator such that the actuator is operable to selectively power the light.

8. The drain cleaner of claim 6, wherein the area in which the actuator is positioned is further defined by the base.

9. The drain cleaner of claim 6, wherein the base is a stand.

10. The drain cleaner of claim 1, wherein the drum assembly includes an inner drum and a drum cover extending over an open forward end of the inner drum.

11. The drain cleaner of claim 10, wherein the flexible cable is stored within a cavity defined by the inner drum and the drum cover.

12. The drain cleaner of claim 10, wherein the drum assembly further includes a drum support that supports the inner drum.

13. The drain cleaner of claim 12, wherein the inner drum, the drum cover, and the drum support rotate together.

14. The drain cleaner of claim 12, wherein the inner drum is captured between the drum support and the drum cover.

15. The drain cleaner of claim 12, wherein the drum cover is coupled to the drum support with fasteners.

16. The drain cleaner of claim 10, further comprising a nose assembly forward of the drum assembly.

17. The drain cleaner of claim 16, wherein the drum cover includes an extended portion that extends away from the drum assembly and into the nose assembly.

* * * * *